US010843049B2

(12) United States Patent
Aramaki

(10) Patent No.: US 10,843,049 B2
(45) Date of Patent: Nov. 24, 2020

(54) GOLF CLUB HEAD

(71) Applicant: Sumitomo Rubber Industries, Ltd., Hyogo (JP)

(72) Inventor: Tomotaka Aramaki, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/352,572

(22) Filed: Mar. 13, 2019

(65) Prior Publication Data

US 2019/0282864 A1 Sep. 19, 2019

(30) Foreign Application Priority Data

Mar. 15, 2018 (JP) ..... 2018-48131

(51) Int. Cl.
*A63B 53/04* (2015.01)
*A63B 53/08* (2015.01)
*A63B 102/32* (2015.01)

(52) U.S. Cl.
CPC .. *A63B 53/0466* (2013.01); *A63B 2053/0458* (2013.01); *A63B 2102/32* (2015.10)

(58) Field of Classification Search
CPC ..... A63B 53/0466; A63B 2053/0458; A63B 2102/32
USPC ..... 473/329, 324
See application file for complete search history.

(56) References Cited

U.S. PATENT DOCUMENTS

2002/0068646 A1* 6/2002 Yoneyama ..... A63B 53/04 473/345
2005/0101407 A1* 5/2005 Hirano ..... A63B 53/0466 473/342
2005/0124436 A1* 6/2005 Kakiuchi ..... A63B 53/0466 473/345
2005/0209022 A1* 9/2005 Yamamoto ..... A63B 53/0466 473/345
2006/0019770 A1* 1/2006 Meyer ..... A63B 53/0466 473/349
2012/0157227 A1* 6/2012 Morin ..... A63B 53/0466 473/330
2015/0375068 A1* 12/2015 Mizutani ..... A63B 53/0466 473/324
2016/0354654 A1* 12/2016 Kato ..... A63B 53/0466

FOREIGN PATENT DOCUMENTS

JP 2003-126310 A 5/2003

* cited by examiner

*Primary Examiner* — John E Simms, Jr.
(74) *Attorney, Agent, or Firm* — Studebaker & Brackett PC

(57) ABSTRACT

A golf club head includes a striking face. The striking face includes: a face center; a face center region that is a square region having a height of 10 mm and a width of 10 mm, a center of figure of the face center region being located at the face center; a central thick portion that includes the face center region and has a first thickness; and a peripheral thin portion that is located on a periphery of the central thick portion and is thinner than the central thick portion. A CT maximum point is present in the face center region. A shape of an outer edge of the peripheral thin portion is not similar to that of an outer edge of the central thick portion. A difference in thickness between the central thick portion and the peripheral thin portion is 0.3 mm or less.

13 Claims, 4 Drawing Sheets

GOLF CLUB HEAD

The present application claims priority on Patent Application No. 2018-48131 filed in Japan on Mar. 15, 2018, the entire contents of which are hereby incorporated by reference.

BACKGROUND OF THE INVENTION

Field of the Invention

The present disclosure relates to a golf club head.

Description of the Related Art

A golf club head in which rebound performance is improved without durability being impaired is desirable. Japanese Patent Laid-Open No. 2003-126310 discloses a golf club head in which a ratio between a thickness of a central region of a face portion and a thickness of a peripheral region of the face portion is specified.

SUMMARY OF THE INVENTION

The inventor has found that there is room for improvement in conventional thickness distribution. The present disclosure provides a golf club head in which the thickness distribution of a striking face is improved.

A golf club head according to one aspect includes a striking face. The striking face includes: a face center; a face center region that is a square region having a height of 10 mm and a width of 10 mm, a center of figure of the face center region being located at the face center; a central thick portion that includes the face center region and has a first thickness; and a peripheral thin portion that is located on a periphery of the central thick portion and is thinner than the central thick portion. A CT maximum point at which a CT value is at a maximum is present in the face center region. A shape of an outer edge of the peripheral thin portion is not similar to a shape of an outer edge of the central thick portion. A difference in thickness between the central thick portion and the peripheral thin portion is equal to or less than 0.3 mm.

DESCRIPTION OF THE PREFERRED EMBODIMENTS

[Findings Serving as a Basis of the Present Disclosure]

From the standpoint of improving rebound performance while maintaining the strength of a striking face, a structure (peripheral thin structure) in which a central portion of the striking face is made thick and a peripheral portion of the striking face is made thin may be employed.

However, a new problem has been found in this peripheral thin structure. It has become clear that, in this structure, a CT maximum point at which a CT value is at the maximum tends to be located outside of a face center region. The face center region is a region in which a striking point is highly likely to be located. When the CT maximum point is located outside of the face center region, a coefficient of restitution in the face center region where the striking point is highly likely to be located decreases. As a result, an average flight distance decreases.

The present disclosure is based on the above findings.

The following describes an embodiment in detail with reference to the accompanying drawings as appropriate.

The definitions of terms used in the present application are as follows.

[Reference State, Reference Perpendicular Plane]

Figure 4:
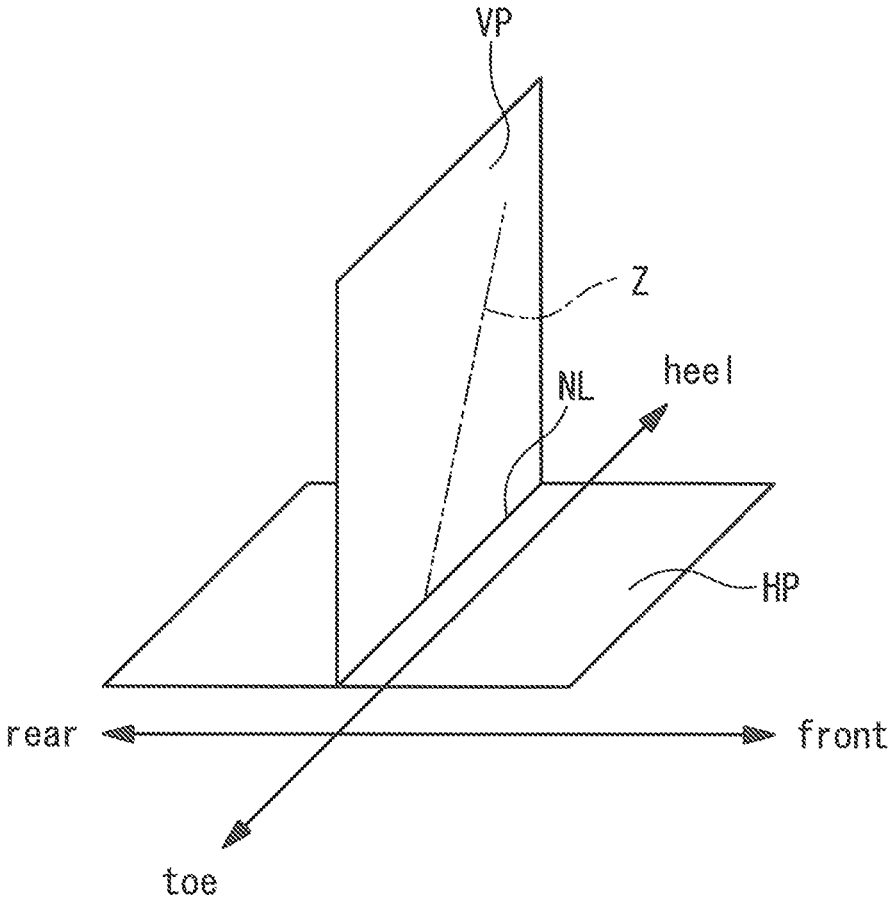
FIG. 4 is a diagram for illustrating a toe-heel direction and a front-rear direction.

The reference state is a state where a head is placed at a predetermined lie angle and face angle on a horizontal plane HP. As shown in FIG. 4, in the reference state, a center line Z of a hosel hole is contained in a plane VP perpendicular to the horizontal plane HP. The plane VP is defined as a reference perpendicular plane. The predetermined lie angle and face angle are shown in a product catalog, for example.

[Toe-Heel Direction]

The toe-heel direction is a direction of an intersection line NL between the reference perpendicular plane VP and the horizontal plane HP (see FIG. 4)

[Front-Rear Direction]

The front-rear direction is a direction perpendicular to the toe-heel direction and parallel to the horizontal plane HP. In the present application, the terms "front side", "forward", "rear side", "rearward", and the like are determined based on this front-rear direction.

[Up-Down Direction]

The up-down direction is a direction perpendicular to the toe-heel direction and perpendicular to the front-rear direction. In other words, the up-down direction in the present application is a direction perpendicular to the horizontal plane HP. In the present application, the terms "upper side", "upward", "lower side", "downward", and the like are determined based on this up-down direction.

[Face Center]

The face center is determined as follows. First, an arbitrary point Pr is selected at roughly the center of a face surface in the up-down direction and toe-heel direction. Next, a plane that passes through this point Pr, extends in the direction of a line normal to the face surface at the point Pr, and is parallel to the toe-heel direction is determined. An intersection line between this plane and the face surface drawn, and a midpoint Px of the intersection line is determined. Next, a plane that passes through the midpoint Px, extends in the direction of a line normal to the face surface at the midpoint Px, and is parallel to the up-down direction is determined. An intersection line between this plane and the face surface is drawn, and a midpoint Py of the intersection line is determined. Next, a plane that passes through the midpoint Py, extends in the direction of a line normal to the face surface at the midpoint Py, and is parallel to the toe-heel direction is determined. An intersection line between this plane and the face surface is drawn, and a midpoint Px of the intersection line is newly determined. Next, a plane that passes through this new midpoint Px, extends in the direction of a line normal to the face surface at this midpoint Px, and is parallel to the up-down direction is determined. An intersection line between this plane and the face surface is drawn, and a midpoint Py of the intersection line is newly determined. Such points Px and Py are sequentially determined through repetition of this process. When a distance between a new midpoint Py and an immediately preceding midpoint Py first becomes equal to or less than 0.5 mm during repetition of this process, new midpoint Py (last midpoint Py) is the face center.

[Projection Plane]

When a straight line that passes through the face center and is perpendicular to the face surface is defined as a face normal line, a plane perpendicular to the face normal line is a projection plane.

[Plan View]

Figure 1:
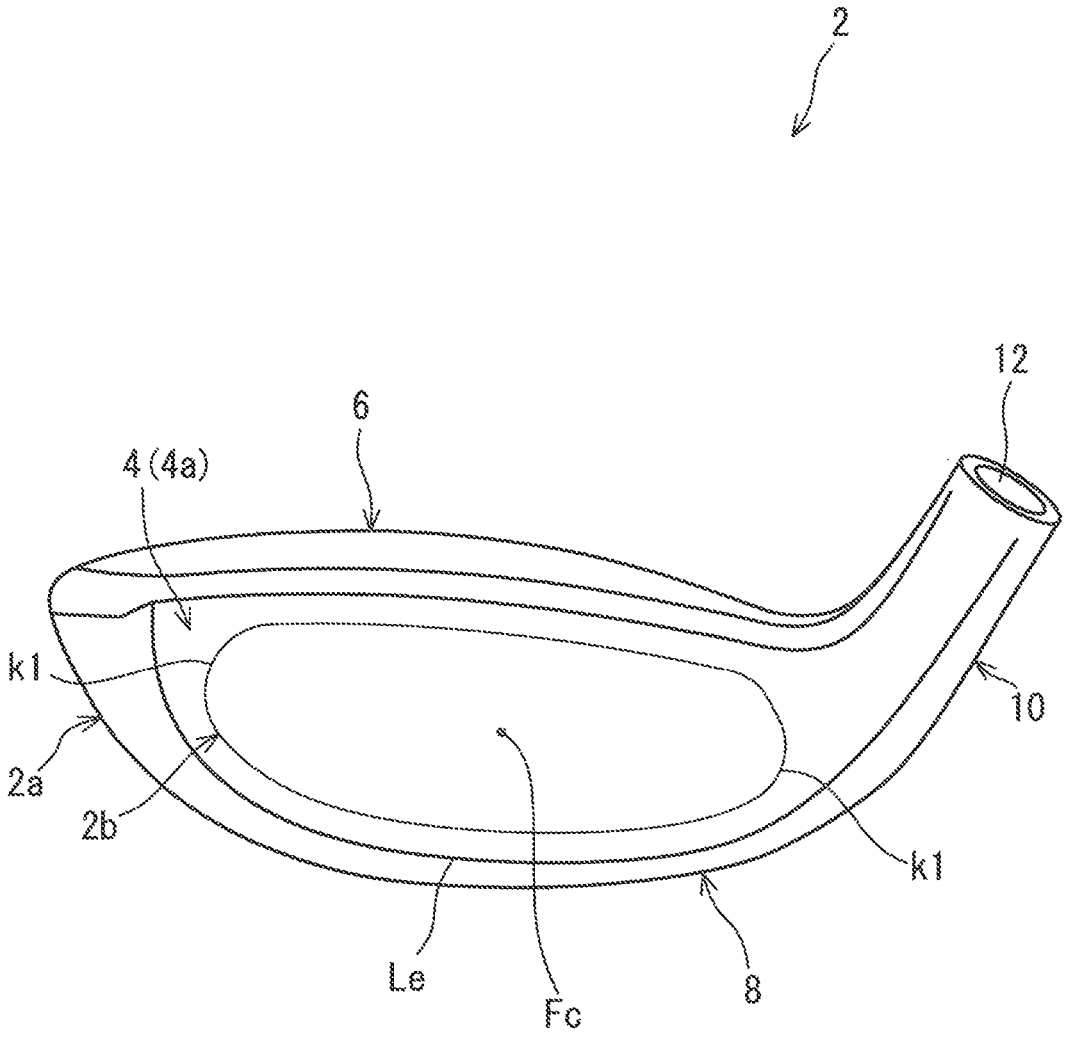
FIG. 1 is a front view of a golf club head according to an embodiment.
Figure 2:
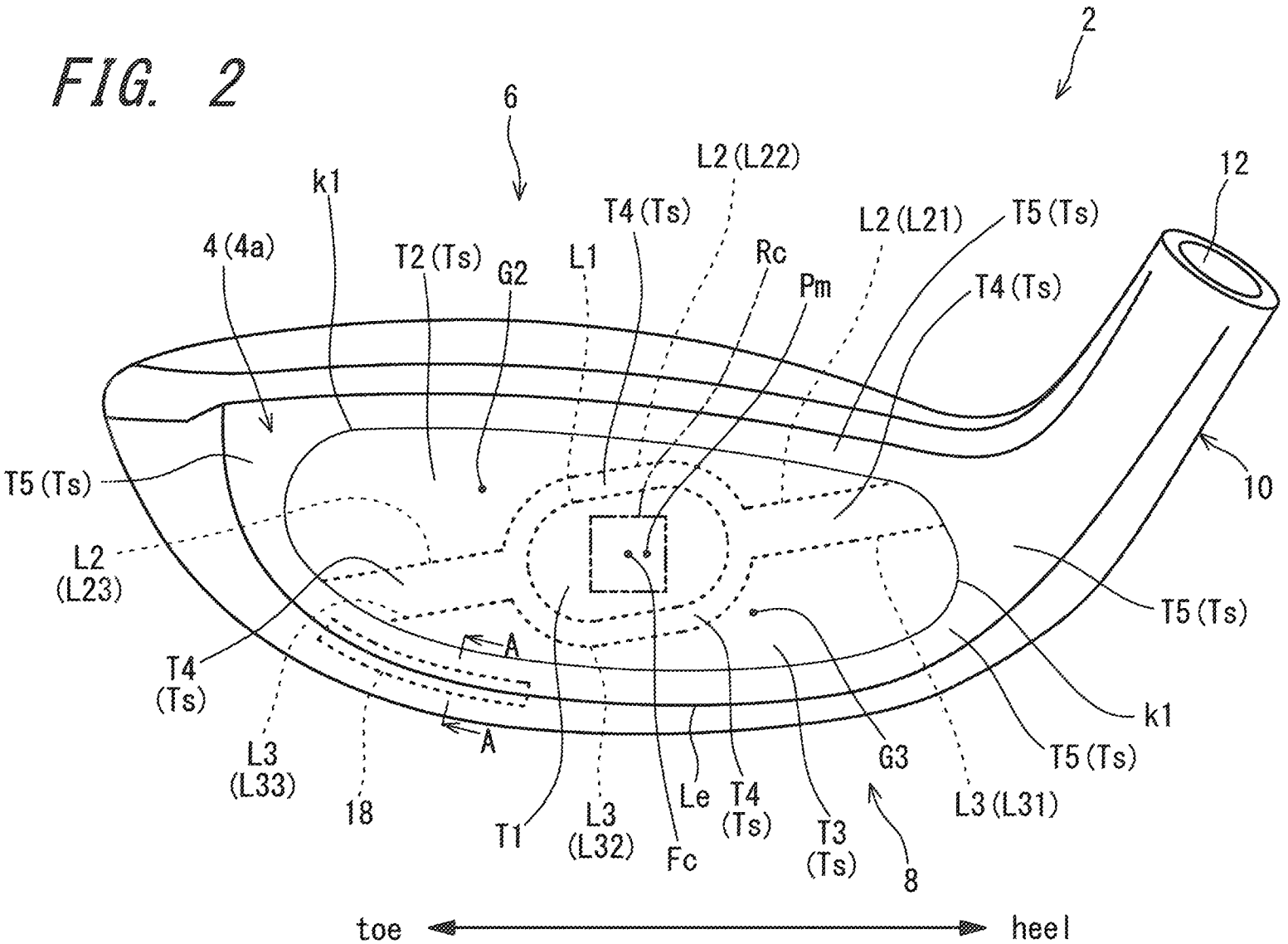
FIG. 2 is an enlarged view of FIG. 1.

A projection image projected onto the projection plane is defined as the plan view. Note that the projection image is projected in a direction of the face normal line onto the projection plane. FIGS. 1 and 2 described later are plan views. The term "center of figure" in the present application means the center of figure in the plan view. The term "area" in the present application means the area in the plan view. The term "shape" in the present application means the shape in the plan view. The term "distance" in the present application means the distance in the plan view.

[Lateral Direction, Vertical Direction]

The lateral direction is a direction of a projected straight line that is obtained by projecting a straight line extending in the toe-heel direction onto the projection plane. The vertical direction is a direction of a straight line that is perpendicular to the lateral direction in the projection plane. A length in the lateral direction is also referred to as "width". A length in the vertical direction is also referred to as "height".

Figure 3:
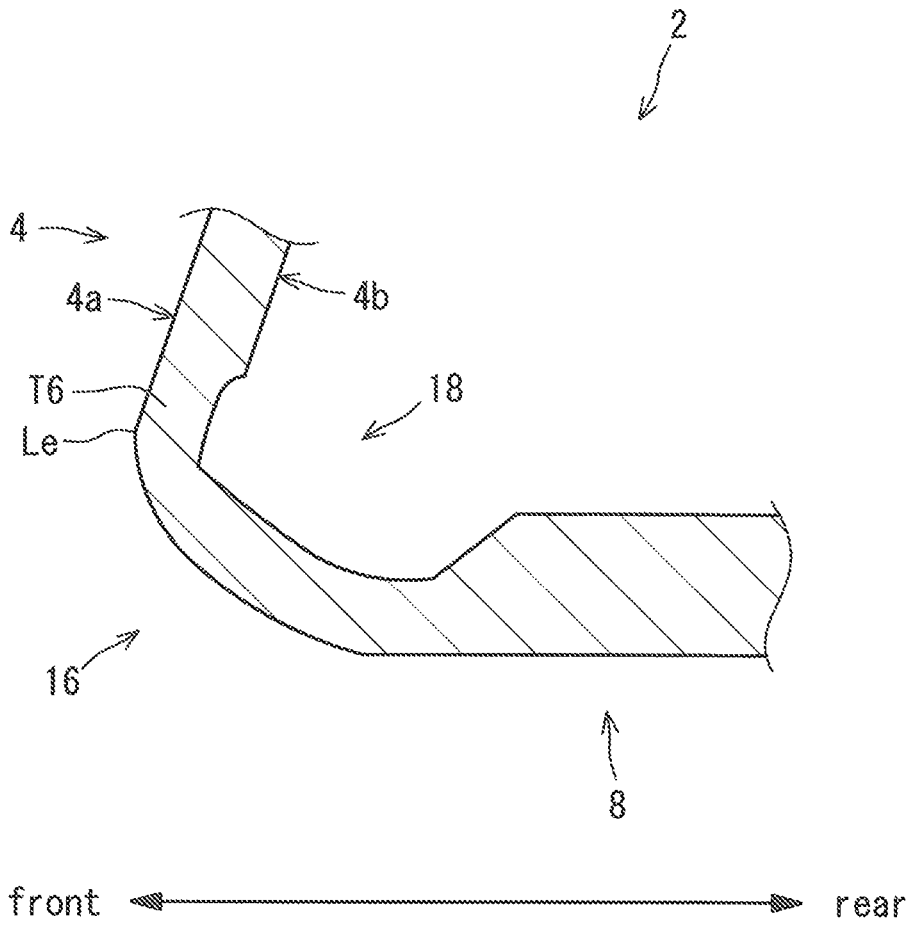
FIG. 3 is a cross-sectional view taken along line A-A in FIG. 2.

FIG. 1 is a front view of a golf club head 2 according to an embodiment. FIG. 2 is an enlarged view of FIG. 1. In FIG. 2, ridge lines and valley lines that are formed on a face rear surface are indicated with dashed lines. FIG. 3 is a cross-sectional view taken along line A-A in FIG. 2.

The head 2 includes a striking face 4, a crown 6, a sole 8, and a hosel 10. The striking face 4 includes a face surface 4*a* and a face rear surface 4*b*. The face surface 4*a* is an outer surface of the striking face 4. The face rear surface 4*b* is an inner surface of the striking face 4. The hosel 10 includes a hosel hole 12. The head 2 is hollow.

The striking face 4 has a face center Fc. The striking face 4 has a leading edge Le. The leading edge Le is a lower edge of the face surface 4*a*.

The face surface 4*a* is a three-dimensional curved surface that projects outward. The face surface 4*a* has bulge and roll, as with general wood-type heads. Note that, although score lines are provided on the face surface 4*a*, the score lines are omitted in the drawings.

The head 2 includes a body 2*a* and a face member 2*b*. The head 2 is formed by joining the face member 2*b* to the body 2*a*. The joining is performed by welding. The face member 2*b* is a plate-shaped member. The body 2*a* has an opening that corresponds to the contour shape of the face member 2*b* and the opening is closed by the face member 2*b*. An outer edge k1 of the face member 2*b* is shown in FIGS. 1 and 2. The face member 2*b* is welded to the body 2*a* on the outer edge k1. The outer edge k1 is the boundary between the body 2*a* and the face member 2*b*. Note that the face member 2*b* need not be used. An integrally formed body may include the whole of the striking face. Alternatively, the head may be constituted by a body and a cup face that includes the whole of the striking face. The cup face may include the whole of the striking face, a part of the crown, and a part of the sole.

The material of the body 2*a* is not limited. Examples of the material of the body 2*a* include a metal and CFRP (carbon fiber reinforced plastic). Examples of the metal include one or more metals selected from pure titanium, a titanium alloy, stainless steel, maraging steel, an aluminum alloy, a magnesium alloy, and a tungsten-nickel alloy.

The material of the face member 2*b* is not limited, and is preferably a metal. From the standpoint of strength, a titanium alloy and maraging steel are preferable examples of the material.

Manufacturing methods of the body 2*a* and the face member 2*b* are not limited. For example, the body 2*a* can be manufactured by casting. The face member 2*b* can be manufactured by pressing a plate material. A rolled material can be used as the plate material. A rolled material has few defects and is excellent in strength. Furthermore, a rolled material has high accuracy in thickness. The use of a rolled material improves accuracy of the thickness of the striking face 4. The face member 2*b* can also be manufactured by forging, for example.

A rear face of the face member 2*b* constitutes the face rear surface 4*b*. The rear face of the face member 2*b* is formed by NC processing. NC processing improves accuracy of the thickness of the striking face 4. NC is an abbreviation of "numerical control". More specifically, the rear face of the face member 2*b* is formed by CNC processing. CNC is an abbreviation of "computerized numerical control".

The striking face 4 (face surface 4*a*) has a face center region Rc. The face center region Rc is a region that is hounded by a square who se center of figure is located at the face center Fc. The square has two sides that extend in the vertical direction and two sides that extend in the lateral direction. The sides extending in the vertical direction have a length of 10 mm. The sides extending in the lateral direction have a length of 10 mm. The center of figure of the face center region Rc coincides with the face center Fc. Note that the face center region Rc is determined in the plan view.

CT values can be measured at respective points on the face surface 4*a*. CT is an abbreviation of "characteristic time". The CT values are measured by the pendulum test. Details of the pendulum test are appeared in "Technical Description of the Pendulum Test" appended to "Notice To Manufacturers" issued by USGA on Feb. 24, 2003. The unit of the CT value is μs. The larger the CT value is, the higher rebound performance tends to be.

A CT maximum point Pm at which the CT value is at the maximum is present in the face center region Rc. In determination of the CT maximum point, a large number of measurement points are set on the face surface 4*a*. These measurement points are set at intervals of 5 mm in the vertical direction and the lateral direction, with the face center Fc as the base point. These measurement points are determined in the plan view. Of these measurement points, a measurement point that has the largest CT value is the CT maximum point Pm. Note that measurement results of the CT values at the respective measurement points are shown in Examples described later.

As shown in FIG. 2, the striking face 4 has a central thick portion T1. The central thick portion T1 is located in a central part of the striking face 4. The central thick portion T1 includes the face center Fc. The central thick portion T1 includes the face center region Rc. The central thick portion T1 includes the whole of the face center region Rc.

The central thick portion T1 has a first thickness t1. In the present embodiment, the central thick portion T1 is a region surrounded by a boundary line L1. The boundary line L1 is a ridge line on the face rear surface 4*b*. The boundary line L1 has a shape of a rectangle with rounded corners. The shape of the boundary line L1 is not limited. Note that the first thickness t1 may have a tolerance of ±0.1 mm.

The striking face 4 has an upper thin portion T2. A center of figure G2 of the upper thin port on T2 is located at the toe side with respect to the face center Fc. The center of figure G2 of the upper thin portion T2 is located at the upper side with respect to the face center Fc. The upper thin portion T2 has an area larger than that of the central thick portion T1.

The upper thin portion T2 has a second thickness t2. In the present embodiment, the upper thin portion T2 is a region surrounded by a boundary line L2 and the outer edge k1. The boundary line L2 includes a heel straight portion L21, a curved portion L22, and a toe straight portion L23. The heel straight portion L21 extends from a point on the outer edge k1 that is located at the heel side with respect to the face center Fc to a heel-side end of the curved portion L22. The heel straight portion L21 is inclined downward toward the toe side. The curved portion L22 extends along the boundary line L1. The toe straight portion L23 extends from a point on the outer edge k1 that is located at the toe side with respect to the face center Fc to a toe-side end of the curved portion L22. The toe straight portion L23 is inclined downward toward the toe side. A toe-side end of the boundary line L2 is located lower than a heel-side end of the boundary line L2. Note that the second thickness t2 may have a tolerance of ±0.1 mm.

The striking face 4 has a lower thin portion T3. A center of figure G3 of the lower thin portion T3 is located at the heel side with respect to the face center Fc. The center of figure G3 of the lower thin portion T3 is located at the lower side with respect to the face center Fc. The lower thin portion T3 has an area larger than that of the central thick portion T1.

The lower thin portion T3 is located lower than the upper thin portion T2. The lower thin portion T3 is located lower than the upper thin portion T2 at any positions in the toe-heel direction. The center of figure G3 of the lower thin portion T3 is located lower than the center of figure G2 of the upper thin portion T2. The center of figure G3 of the lower thin portion T3 is located at the heel side with respect to the center of figure G2 of the upper thin portion T2.

The lower thin portion T3 has a third thickness t3. In the present embodiment, the lower thin portion T3 is a region surrounded by a boundary line L3 and the outer edge k1. The boundary line L3 is located lower than the boundary line L2. The boundary line L3 includes a heel straight portion L31, a curved portion L32, and a toe straight portion L33. The heel straight portion L31 extends from a point on the outer edge k1 that is located at the heel side with respect to the face center Fc to a heel-side end of the curved portion L32. The heel straight portion L31 is inclined downward toward the toe side. The curved portion L32 extends along the boundary line L1. The toe straight portion L33 extends from a point on the outer edge k1 that is located at the toe side with respect to the face center Fc to a toe-side end of the curved portion L32. The toe straight portion L33 is inclined downward toward the toe side. A toe-side end of the boundary line L3 is located lower than a heel-side end of the boundary line L3. Note that the third thickness t3 may have a tolerance of ±0.1 mm.

The striking face 4 has a transition portion T4. The transition portion T4 is located between the central thick portion T1 and the upper thin portion T2, between the central thick portion T1 and the lower thin portion T3 and between the upper thin portion T2 and the lower thin portion T3. The transition portion T4 is located between two regions having different thicknesses, and the thickness of the transition portion T4 gradually changes from one of the thicknesses to the other of the thicknesses. The transition portion T4 is thinner than the central thick portion T1.

The striking face 4 has an outer peripheral thin portion T5. The outer peripheral thin portion T5 is located outside of the upper thin portion T2. The outer peripheral thin portion T5 is located outside of the lower thin portion T3. When a region constituted by the central thick portion T1, the upper thin portion T2, the lower thin portion T3, and the transition portion T4 is defined as a face main region, the outer peripheral thin portion T5 is located outside of the face main region. The outer peripheral thin portion T5 is provided along the whole periphery of the face main region. In the present embodiment, the outer peripheral thin portion T5 is provided outside of the face member 2*b*. The outer peripheral thin portion T5 is formed by the head body 2*a*. An inner boundary line of the outer peripheral thin portion T5 is the outer edge k1 of the face member 2*b*. Note that a weld bead is present on the outer edge k1. A part on which the weld bead is present is thicker than the central thick portion T1.

The outer peripheral thin portion T5 is thinner than the central thick portion T1. The outer peripheral thin portion T5 is thinner than the upper thin portion T2. The thickness of the outer peripheral thin portion T5 is equal to or less than the thickness of the lower thin portion T3. The outer peripheral thin portion T5 is thinner than the transition portion T4. Note that the thickness of the outer peripheral thin portion T5 may be equal to the thickness of the lower thin portion T3 or less than the thickness of the lower thin portion T3. The thickness of the outer peripheral thin portion T5 may be equal to or less than the thickness of the upper thin portion T2 and equal to or greater than the thickness of the lower thin portion T3. From the standpoint of rebound performance, the thickness of the outer peripheral thin portion T5 is preferably equal to or less than the thickness of the lower thin portion T3.

The striking face 4 has a peripheral thin portion Ts. The peripheral thin portion Ts is thinner than the central thick portion T1. In the present embodiment, the peripheral thin portion Ts is constituted by the upper thin portion T2, the lower thin portion T3, the transition portion T4, and the outer peripheral thin portion T5.

The shape of the outer edge of the peripheral thin portion Ts s not similar to the shape of the outer edge of: the central thick portion T1. These shapes are in a dissimilar to each other. In the present embodiment, the shape of the outer edge of the peripheral thin portion Ts is the shape of the striking face 4. In the present embodiment, the shape of the outer edge of the central thick portion T1 is the shape formed by the boundary line L1 (rectangle with rounded corners).

The center of gravity of the peripheral thin portion Ts does not coincide with the center of gravity of the central thick portion T1. The location of the center of gravity of the peripheral thin portion Ts is different from the location of the center of gravity of the central thick portion T1. Note that the term "center of gravity" has its usual meaning, that is, the center of mass, and does not mean the center of figure in the plan view. The center of gravity of the peripheral thin portion Ts may fall on the heel side with respect to the center of gravity of the central thick portion T1. The center of gravity of the peripheral thin portion Ts may fall on the toe side with respect to the center of gravity of the central thick portion T1. The center of gravity of the peripheral thin portion Ts may fall on the upper side with respect to the center of gravity of the central thick portion T1. The center of gravity of the peripheral thin portion Ts may fall on the lower side with respect to the center of gravity of the central thick portion T1.

[Advantageous Effects]

By promoting the peripheral thin structure, rebound performance can be improved while durability is maintained.

However, it was found that the peripheral thin structure causes the CT maximum point to be located outside of the face center region.

The face center region is a region in which a striking point is highly likely to be located. When the CT maximum point is not located within the face center region, the coefficient of restitution in the face center region decreases. As a result of the coefficient of restitution decreasing in the region that frequently strikes a ball, an average flight distance decreases.

It has been found that the CT maximum point can be prevented from being located outside of the face center region by reducing a difference in thickness between the central thick portion T1 and the peripheral thin portion Ts. As shown in the Examples described later, it has been found that the CT maximum point Pm can be kept within the face center region Rc when the difference in thickness between the central thick portion T1 and the peripheral thin portion Ts is equal to or less than 0.3 mm.

The CT maximum point Pm tends to be located outside of the face center region Rc when the above-described dissimilar relationship is present. Therefore, the present disclosure is more effective when the shape of the outer edge of the peripheral thin portion Ts is not similar to the shape of the outer edge of the central thick portion T1.

The CT maximum point Pm tends to be located outside of the face center region Rc when the location of the center of gravity of the peripheral thin portion Ts is different from the location of the center of gravity of the central thick portion T1. Therefore, the present disclosure is more effective when the location of the center of gravity of the peripheral thin portion Ts is different from the location of the center of gravity of the central thick portion T1.

From the standpoint of keeping the CT maximum point Pm within the face center region Rc, the difference in thickness between the central thick portion T1 and the peripheral thin portion Ts is preferably equal to or less than 0.3 mm, and more preferably equal to or less than 0.2 mm. From the standpoint of rebound performance and durability, the difference in thickness between the central thick portion T1 and the peripheral thin portion Ts is preferably equal to or greater than 0.1 mm.

From the standpoint of rebound performance, the thickness t1 of the central thick portion T1 is preferably equal to or less than 2.3 mm, more preferably equal to or less than 2.2 mm, and still more preferably equal to or less than 2.1 mm. From the standpoint of durability, the thickness t1 is preferably equal to or greater than 1.5 mm, more preferably equal to or greater than 1.6 mm, and still more preferably equal to or greater than 1.7 mm.

From the standpoint of rebound performance, the thickness t2 of the upper thin portion T2 is preferably equal to or less than 2.2 mm, more preferably equal to or less than 2.1 mm, and still more preferably equal to or less than 2.0 mm. From the standpoint of durability, the thickness t2 is preferably equal to or greater than 1.4 mm, more preferably equal to or greater than 1.5 mm, and still more preferably equal to or greater than 1.6 mm.

From the standpoint of rebound performance, the thickness t3 of the lower thin portion T3 is preferably equal to or less than 2.1 mm, more preferably equal to or less than 2.0 mm, and still more preferably equal to or less than 1.9 mm. From the standpoint of durability, the thickness t3 is preferably equal to or greater than 1.3 mm, more preferably equal to or greater than 1.4 mm, and still more preferably equal to or greater than 1.5 mm.

When the lower thin portion T3 is made thinner than the upper thin portion T2, rebound performance is improved in a lower portion of the face surface 4*a*. Additionally, when the difference in thickness between the central thick portion T1 and the peripheral thin portion Ts is set to be equal to or less than 0.3 mm, rebound performance can be improved in the lower portion of the face surface 4*a* while the CT maximum point Pm is kept within the face center region Rc.

From the standpoint of rebound performance, the thickness t5 of the outer peripheral thin portion T5 is preferably equal to or less than 2.1 mm, more preferably equal to of less than 1.9 mm, and still more preferably equal to or less than 1.8 mm. From the standpoint of durability, the thickness t5 is preferably equal to or greater than 1.2 mm, more preferably equal to or greater than 1.3 mm, and still more preferably equal to or greater than 1.4 mm.

Fairway wood-type heads and hybrid-type heads are often used for striking a ball that is not teed up. In other words, fairway wood-type heads and hybrid-type heads are often used for striking a ball that is directly placed on the grass. Therefore, when these heads are used, the ball is often struck with the lower portion of the face surface 4*a*. From this standpoint, the configuration in which the lower thin portion T3 is thinner than the upper thin portion T2 is preferably applicable to fairway wood-type heads and hybrid-type heads.

The CT maximum point Pm tends to be located outside of the face center region Rc when the difference in thickness between the lower thin portion T3 and the upper thin portion T2 is large. Therefore, the present disclosure is more effective when the difference (t2−t3) is large. From this standpoint, the difference (t2−t3) is preferably equal to or greater than 0.05 mm, and more preferably equal to or greater than 0.1 mm. From the standpoint of reducing the difference in thickness between the central thick portion T1 and the peripheral thin portion Ts, the difference (t2−t3) is preferably equal to or less than 0.4 mm, more preferably equal to or less than 0.3 mm, and still more preferably equal to or less than 0.2 mm.

The CT maximum point Pm tends to be located outside of the face center region Rc when the area Sb of the peripheral thin portion Ts is large relative to the area Sa of the central thick portion T1. Therefore, the present disclosure is more effective when a ratio Sb/Sa is large. From this standpoint, the ratio Sb/Sa is preferably equal to or greater than 3, more preferably equal to or greater than 4, and still more preferably equal to or greater than 5. From the standpoint of strength, an extremely small area Sa is not preferable. From this standpoint, the ratio Sb/Sa is preferably equal to or less than 8, more preferably equal to or less than 7, and still more preferably equal to or less than 6.

As described above, the lower thin portion T3 is thinner than the upper thin portion T2. The center of gravity of the peripheral thin portion Ts tends not to coincide with the center of gravity of the central thick portion T1 when the distance between the center of figure G2 and the center of figure G3 is large. Therefore, the present disclosure is more effective when this distance is large. From this standpoint, the distance between the center of figure G2 and the center of figure G3 is preferably equal to or greater than 20 mm, more preferably equal to or greater than 25 mm, and still more preferably equal to or greater than 30 mm. When restrictions on the dimensions of the striking face 4 are taken into consideration, the distance between the center of figure G2 and the center of figure G3 is preferably equal to or less than 70 mm, more preferably equal to or less than 60 mm, and still more preferably equal to or less than 50 mm.

As shown in FIG. 3, the head 2 includes a corner portion 16 that is located at the boundary between the striking face 4 and the sole 8. The corner portion 16 has a corner groove 18 on the inner surface thereof. The corner groove 18 overlaps the leading edge Le in the plan view. That is, the corner groove 18 is located at a position that overlaps the leading edge Le in the plan view. The corner groove 18 forms thin groove portion T6 in the striking face 4. The thin groove portion T6 is thinner than the upper thin portion T2. The thin groove portion T6 is thinner than the lower thin portion T3. The thin groove portion T6 is thinner than the outer peripheral thin portion T5. The thin groove portion T6 is the thinnest portion of the striking face 4. The corner groove 18 reduces the rigidity of the lower portion of the striking face 4. The corner groove 18 improves rebound performance that is exhibited when a ball is struck with the lower portion of the face surface 4*a*.

The center of figure G3 of the lower thin portion T3 is located at the heel side with respect to the face center Fc. The lower thin portion T3 particularly improves the rebound performance of a lower portion on the heel side. Meanwhile, the corner groove 18 is provided on the toe side with respect to the face center Fc. The corner groove 18 particularly improves the rebound performance of a lower portion on the toe side. The rebound performance is improved in the lower portion of the striking face 4 from the toe side to the heel side by the lower thin portion T3 and the corner groove 18.

In general, head speeds at impact differ between a toe side portion and a heel side portion of the head. The head speed of the toe side portion is higher than that of the heel side portion. This difference arises from rotation of the head about the shaft axis. The radius of this rotation is larger in the toe side portion than in the heel side portion, and therefore the head speed of the toe side portion is relatively high. As a result, the flight distance tends to increase when the ball is struck with the toe side portion as compared with a case where the ball is struck with the heel side portion.

In the head 2, the center of figure G3 of the lower thin portion T3 is located at the heel side with respect to the center of figure G2 of the upper thin portion T2. As a result of the thinner lower thin portion T3 beings located on the heel side, rebound performance is improved in the heel side portion of the face surface 4*a*. As a result of rebound performance being improved in the heel side portion, the head speed in the heel side portion can be compensated and a high rebound area can be expanded in the toe-heel direction.

The outer peripheral thin portion T5 may not be present. In the above-described embodiment the outer peripheral thin portion T5 is provided. In the above-described embodiment, the outer peripheral thin portion T5 is provided in the head body 2*a*. As a result of the outer peripheral thin portion T5, which is located on the periphery of the face member 2*b*, being provided in the head body 2*a*, the whole of the face member 2*b* can be effectively displaced. This displacement contributes to improvement in coefficient of restitution.

The position of a sweet spot tends to be high in a head that has a high loft angle. The sweet spot is the point of intersection between the face surface and a straight line that passes through the center of gravity of the head and is perpendicular to the face surface. Therefore, even when the position of the center at gravity of the head is the same, the position of the sweet spot becomes higher as the loft angle increases. Accordingly, in a head having a high loft angle, rebound tends to be high in an upper portion of the face. By applying the above-described configuration including the upper thin portion T2 and the lower thin portion T3 to this head, rebound is also improved in a lower portion of the face. As a result, it is possible to obtain a high rebound area that is wide in the up-down direction. From this standpoint, the real loft angle is preferably equal to or greater than 14 degrees, more preferably equal to or greater than 15 degrees, and still more preferably equal to or greater than 16 degrees. When the left angles of fairway wood-type heads and hybrid-type heads are taken into consideration, the real loft angle is preferably equal to or less than 35 degrees.

EXAMPLES

[Preparation of Samples]

A Head that was the same as the above-described head 2 was prepared. The head was a hybrid-type head and had a real loft angle of 19 degrees. The body 2*a* was prepared by lost-wax precision casting. Maraging steel was used as the material of the body 2*a*. The face member 2*b* was prepared by forging and CNC processing was performed on the rear surface thereof. Stainless steel (product name "HT1770M" manufactured by Nisshin Steel Co., Ltd.) was used as the material of the face member 2*b*. A head of Sample 1 was obtained by welding the body 2*a* and the face member 2*b*.

Heads of Samples 2 to 5 were obtained in the same manner as the head of Sample 1 except that thicknesses were changed by the CNC processing.

The thicknesses of the samples were as follows.

[Sample 1]

Thickness t1 of Central Thick Portion T1: 2.00 mm

Thickness t2 of Upper Thin Portion T2: 1.95 mm

Thickness t3 of Lower Thin Portion T3: 1.90 mm

Thickness t5 of Outer Peripheral Thin Portion T5: 1.90 mm

Difference in Thickness between Central Thick Portion T1 and Peripheral Thin Portion Ts: 0.10 mm

[Sample 2]

Thickness t1 of Central Thick Portion T1: 2.00 mm

Thickness t2 of Upper Thin Portion T2: 1.90 mm

Thickness t3 of Lower Thin Portion T3: 1.80 mm

Thickness t5 of Outer Peripheral Thin Portion T5: 1.80 mm

Difference in Thickness between Central Thick Portion T1 and Peripheral Thin Portion Ts: 0.20 mm

[Sample 3]

Thickness t1 of Central Thick Portion T1: 2.00 mm

Thickness t2 of Upper Thin Portion T2: 1.80 mm

Thickness t3 of Lower Thin Portion T3: 1.70 mm

Thickness t5 of Cuter Peripheral Thin Portion T5: 1.70 mm

Difference in Thickness between Central Thick Portion T1 and Peripheral Thin Portion Ts: 0.30 mm

[Sample 4]

Thickness t1 of Central Thick Portion T1: 2.00 mm

Thickness t2 of Upper Thin Portion T2: 1.70 mm

Thickness t3 of Lower Thin Portion T3: 1.60 mm

Thickness t5 of Outer Peripheral Thin Portion T5: 1.60 mm

Difference in Thickness between Central Thick Portion T1 and Peripheral Thin Portion Ts: 0.40 mm

[Sample 5]

Thickness t1 of Central Thick Portion T1: 2.00 mm

Thickness t2 of Upper Thin Portion T2: 1.60 mm

Thickness t3 of Lower Thin Portion T3: 1.50 mm

Thickness t5 of Outer Peripheral Thin Portion T5: 1.50 mm

Difference in Thickness between Central Thick Portion T1 and Peripheral Thin Portion Ts: 0.50 mm The CT value was measured with respect to each sample. The measurement method of the CT value was as described above. Measurement results of Sample 1 are shown in Table 1 below. Measurement results of Sample 2 are shown in Table 2 below. Measurement results of Sample 3 are shown in Table 3 below. Measurement results of Sample 4 are shown in Table 4 below. Measurement results of Sample 5 are shown in Table 5 below.

TABLE 1

CT Value Measurement Results (Sample 1: Thickness Difference 0.10 mm)

| | T20 | T15 | T10 | T5 | Fc | H5 | H10 | H15 | H20 |
|---|---|---|---|---|---|---|---|---|---|
| U10 | — | 181 | 186 | 190 | 193 | 186 | 187 | 179 | — |
| U5 | 187 | 201 | 205 | 227 | 230 | 221 | 215 | 210 | 199 |
| Fc | 182 | 190 | 204 | 225 | 235 | 227 | 217 | 207 | 195 |
| L5 | 179 | 195 | 203 | 220 | 227 | 226 | 216 | 203 | 155 |
| L10 | — | 136 | 149 | 153 | 140 | 141 | 112 | 96 | — |

TABLE 2

CT Value Measurement Results (Sample 2: Thickness Difference 0.20 mm)

| | T20 | T15 | T10 | T5 | Fc | H5 | H10 | H15 | H20 |
|---|---|---|---|---|---|---|---|---|---|
| U10 | — | 197 | 192 | 204 | 206 | 186 | 187 | 179 | — |
| U5 | 193 | 202 | 227 | 234 | 234 | 230 | 228 | 218 | 211 |
| Fc | 199 | 205 | 230 | 236 | 235 | 237 | 236 | 226 | 213 |
| L5 | 200 | 210 | 221 | 227 | 232 | 234 | 230 | 229 | 216 |
| L10 | — | 140 | 165 | 172 | 150 | 150 | 122 | 106 | — |

TABLE 3

CT Value Measurement Results (Sample 3: Thickness Difference 0.30 mm)

| | T20 | T15 | T10 | T5 | Fc | H5 | H10 | H15 | H20 |
|---|---|---|---|---|---|---|---|---|---|
| U10 | — | 197 | 192 | 204 | 206 | 186 | 187 | 179 | — |
| U5 | 220 | 221 | 232 | 236 | 234 | 239 | 241 | 240 | 231 |
| Fc | 230 | 232 | 234 | 236 | 240 | 242 | 236 | 232 | 222 |
| L5 | 200 | 220 | 221 | 232 | 232 | 234 | 230 | 229 | 218 |
| L10 | — | 140 | 165 | 172 | 150 | 150 | 122 | 106 | — |

TABLE 4

CT Value Measurement Results (Sample 4: Thickness Difference 0.40 mm)

| | T20 | T15 | T10 | T5 | Fc | H5 | H10 | H15 | H20 |
|---|---|---|---|---|---|---|---|---|---|
| U10 | — | 220 | 220 | 225 | 243 | 234 | 248 | 247 | — |
| U5 | — | 221 | 237 | 236 | 237 | 239 | 252 | 241 | 235 |
| Fc | 230 | 232 | 235 | 236 | 236 | 242 | 236 | 229 | 227 |
| L5 | 200 | 225 | 238 | 232 | 236 | 234 | 230 | 232 | 222 |
| L10 | — | 155 | 170 | 168 | 170 | 165 | 132 | 120 | — |

TABLE 5

CT Value measurement Results (Sample 5: Thickness Difference 0.50 mm)

| | T20 | T15 | T10 | T5 | Fc | H5 | H10 | H15 | H20 |
|---|---|---|---|---|---|---|---|---|---|
| U10 | — | 220 | 220 | 225 | 232 | 257 | 248 | 247 | — |
| U5 | — | 221 | 237 | 236 | 242 | 258 | 262 | 253 | 236 |
| Fc | 230 | 232 | 235 | 236 | 235 | 242 | 250 | 240 | 226 |
| L5 | 240 | 225 | 238 | 232 | 236 | 234 | 235 | 237 | 225 |
| L10 | — | 160 | 175 | 187 | 200 | 180 | 150 | 111 | — |

In each of Tables 1 to 5, T5, H5, and the like shown in the uppermost row indicate positions in the lateral direction. For example, T5 indicates a position that is located at a distance of 5 mm toward the toe side from the face center Fc in the lateral direction. For example, H5 indicates a position that is located at a distance of 5 mm toward the heel side from the face center Fc in the lateral direction. U5, L5, and the like shown in the leftmost column indicate positions in the vertical direction. For example, U5 indicates a position that is located at a distance of 5 mm upward from the face center Fc in the vertical direction. For example, L5 indicates a position that is located at a distance of 5 mm downward from the face center Fc in the vertical direction.

In Sample 1, the CT value of the face center Fc is 235 μs, which is the maximum value, as shown in Table 1. In Sample 1, the face center Fc is the CT maximum point Pm.

In Sample 2, a measurement point located at a distance of 5 mm toward the heel side from the face center Fc has a CT value of 237 μs, which is the maximum value, as shown in Table 2. In Sample 2, the point located at a distance of 5 mm toward the heel side from the face center Fc is the CT maximum point Pm.

In Sample 3, a measurement point located at a distance of 5 mm toward the heel side from the face center Fc has a CT value of 242 μs, which is the maximum value, as shown in Table 3. In Sample 3, the point located at a distance of 5 mm toward the heel side from the face center Fc is the CT maximum point Pm.

In Sample 4, a measurement point located at a distance of 10 mm toward the heel side from the face center Fc and at a distance of 5 mm upward from the face center Fc has a CT value of 252 μs, which is the maximum value, as shown in Table 4. In Sample 4, the point located at a distance of 10 mm toward the heel side and at a distance of 5 mm upward from the face center Fc is the CT maximum point Pm.

In Sample 5, a measurement point located at a distance of 10 mm toward the heel side from the face center Fc and at a distance of 5 mm upward from the face center Fc has a CT value of 262 μs, which is the maximum value, as shown in Table 5. In Sample 5, the point located at a distance of 10 mm toward the heel side and at a distance of 5 mm upward from the face center Fc is the CT maximum point Pm.

In Sample 1, the difference in thickness between the central thick portion T1 and the peripheral thin portion Ts is 0.10 mm, and the CT maximum point Pm is located within the face center region Rc. In Sample 2, the difference in thickness between the central thick portion T1 and the peripheral thin portion Ts is 0.20 mm, and the CT maximum point Pm is located within the face center region Rc. In Sample 3, the difference in thickness between the central thick portion T1 and the peripheral thin portion Ts is 0.30 mm, and the CT maximum point Pm is located within the face center region Rc. In Sample 4, the difference in thickness between the central thick portion T1 and the peripheral thin portion Ts is 0.40 mm, and the CT maximum point Pm is located outside of the face center region Rc. In Sample 5, the difference in thickness between the central thick portion T1 and the peripheral thin portion Ts is 0.50 mm, and the CT maximum point Pm is located outside of the face center region Rc.

The sample heads 1 to 5 have the following configuration a.

[Configuration a]: When the whole of the peripheral thin portion Ts is uniformly changed in thickness without the thickness of the central thick portion T1 being changed, the CT maximum point Pm is located within the face center region Rc in the case where the difference in thickness between the central thick portion T1 and the peripheral thin portion Ts is equal to or greater than 0.10 mm and equal to or less than 0.30 mm, and the CT maximum point Pm is located outside of the face center region Rc in the case where the difference in thickness between the central thick portion T1 and the peripheral thin portion Ts is equal to or greater than 0.40 mm and equal to or less than 0.50 mm.

As described above, the CT maximum point Pm is located within the face center region Rc as long as the difference in thickness between the central thick portion T1 and the peripheral thin portion Ts is equal to or less than 0.30 mm.

The following clauses are disclosed regarding the above-described embodiment.

[Clause 1]

A golf club head comprising a striking face, wherein the striking face includes:

a face center;

a face center region that is a square region having a height of 10 mm and a width of 10 mm, a center of figure of the face center region being located at the face center;

a central thick portion that includes the face center region and has a first thickness; and a peripheral thin portion that is located on a periphery of the central thick portion and is thinner than the central thick portion, a CT maximum point at which a CT value is at a maximum is present in the face center region, a shape of an outer edge of the peripheral thin portion is not similar to a shape of an outer edge of the central thick portion, and a difference in thickness between the central thick portion and the peripheral thin portion is equal to or less than 0.3 mm.

[Clause 2]

The golf club head according to clause 1, wherein a location of a center of gravity of the peripheral thin portion is different from a location of a center of gravity of the central thick portion.

[Clause 3]

The golf club head according to clause 1 or 2, wherein the peripheral thin portion includes an upper thin portion having a second thickness and a lower thin portion having a third thickness that is smaller than the second thickness, and the lower thin portion is located lower than the upper thin portion.

[Clause 4]

The golf club head according to clause 3, wherein the golf club head is a fairway wood-type head or a hybrid-type head.

[Clause 5]

The golf club head according to clause 3 or 4, wherein the golf club head has a real loft angle of equal to or greater than 14 degrees and equal to or less than 35 degrees.

The above description is merely illustrative and various modifications can be made without departing from the principles of the present disclosure.

What is claimed is:

1. A golf club head comprising a striking face, wherein the striking face includes:

a face center;

a face center region that is a square region having a height of 10 mm and a width of 10 mm, a center of figure of the face center region being located at the face center;

a central thick portion that includes the face center region and has a first thickness; and a peripheral thin portion that is located on a periphery of the central thick portion and is thinner than the central thick portion, the peripheral thin portion sharing a boundary with the striking face, a CT maximum point at which a CT value is at a maximum is present in the face center region, a difference in thickness between the central thick portion and the peripheral thin portion is equal to or less than 0.3 mm, and when an area of the central thick portion is denoted by Sa and an area of the peripheral thin portion is denoted by Sb, a ratio Sb/Sa is equal to or greater than 3 and equal to or less than 8.

2. The golf club head according to claim 1, wherein a location of a center of gravity of the peripheral thin portion is different from a location of a center of gravity of the central thick portion.

3. The golf club head according to claim 1, wherein the peripheral thin portion includes an upper thin portion having a second thickness and a lower thin portion having a third thickness that is smaller than the second thickness, the lower thin portion is located lower than the upper thin portion, the second thickness is constant with a tolerance of ±0.1 mm, and the third thickness is constant with a tolerance of ±0.1 mm.

4. The golf club head according to claim 3, wherein the golf club head is a fairway wood-type head or a hybrid-type head.

5. The golf club head according to claim 3, wherein the golf club head has a real loft angle of equal to or greater than 14 degrees and equal to or less than 35 degrees.

6. The golf club head according to claim 3, wherein a center of figure of the lower thin portion is located at a heel side with respect to a center of figure of the upper thin portion.

7. The golf club head according to claim 3, wherein a center of figure of the upper thin portion is located at a toe side with respect to the face center.

8. The golf club head according to claim 3, wherein the upper thin portion has an area larger than an area of the central thick portion.

9. The golf club head according to claim 3, wherein a center of figure of the lower thin portion is located at a heel side with respect to the face center.

10. The golf club head according to claim 3, wherein a distance between a center of figure of the upper thin portion and a center of figure of the lower thin portion is equal to or greater than 20 mm and equal to or less than 70 mm.

11. The golf club head according to claim 3, wherein the lower thin portion has an area larger than an area of the central thick portion.

12. The golf club head according to claim 3, wherein when the thickness of the upper thin portion is denoted by t2 and the thickness of the lower thin portion is denoted by t3, a difference (t2–t3) is equal to or greater than 0.05 mm and equal to or less than 0.2 mm.

13. The golf club head according to claim 1, wherein the difference in thickness between the central thick portion and the peripheral thin portion is equal to or less than 0.2 mm.

* * * * *